United States Patent [19]

Kollar

[11] 3,999,982

[45] Dec. 28, 1976

[54] PROCESS FOR PREVENTING THE OXIDATION OF LIQUID ZINC

[75] Inventor: Richard André Kollar, Douai, France

[73] Assignee: Societe Miniere et Metallurgique de Penarroya, Paris, France

[22] Filed: Oct. 29, 1975

[21] Appl. No.: 626,924

[30] Foreign Application Priority Data

Oct. 31, 1974 France ..... 74.36405

[52] U.S. Cl. ..... 75/86; 75/96

[51] Int. Cl.[2] ..... C22B 19/00

[58] Field of Search ..... 75/86–88, 75/96, 65 R, 14

[56] References Cited

UNITED STATES PATENTS

| | | | |
|---|---|---|---|
| 478,110 | 7/1892 | James | 75/87 |
| 3,862,839 | 1/1975 | Shimizu et al. | 75/86 |
| 3,892,559 | 7/1975 | Quarm | 75/87 |

*Primary Examiner*—M. J. Andrews
*Attorney, Agent, or Firm*—Fleit & Jacobson

[57] ABSTRACT

The invention provides a process for preventing the oxidation of liquid zinc, while at a temperature exceeding 500° C, in a furnace heated by natural gas and utilizing at least one furnace burner, by injecting into the furnace atmosphere comprising air containing free oxygen (preferably an amount of free oxygen of less than 1.5% by volume), a quantity of sulphur dioxide in an amount between about 0.01% and 0.04%, by volume (preferably about 0.02%, by volume) with respect to the volume of the furnace atmosphere. The sulphur dioxide may be provided by low grade gases from a lead foundry or may be produced by the combustion of a sulphur-containing material.

7 Claims, No Drawings

PROCESS FOR PREVENTING THE OXIDATION OF LIQUID ZINC

The present invention relates to a process for preventing the oxidation or, more precisely, the reoxidation of liquid zinc. It is in fact known that the operations following the manufacture of zinc, such as distillation, the preparation of alloys or casting ingots necessitate keeping the metal in numerous furnaces for maintaining its temperature or recasting. These furnaces, usually called "reverberatory furnaces" are heated by one or more burners the flames of which contact the liquid zinc bath, the temperature of the latter often being over 500° C. However, there are formed in these furnaces significant quantities of scale, composed mainly of oxides.

This situation causes serious problems for users, which will be discussed below.

First, the oxides formed are skimmed off by hand throughout the operations, which is a very arduous task for a man, and adversely affects the production costs, due as much to labour costs as to heat losses through the open doors during skimming off.

The reoxidation of zinc reduces productivity, since it is necessary to recycle the oxides to the start of the process. In addition, the scale takes the place of the liquid zinc and, because of its low thermal conductivity, impedes the normal heating of the zinc by the burner or burners which, it should be remembered, are situated on the surface of the bath.

Finally, the power of the burners used is relatively low, for example of the order of 1000 therms per hour, and, to simplify their use, they are supplied with domestic fuel. However, for obvious economic reasons, and particularly during an energy crisis, it would be desirable to use natural gas, such as that coming from the Netherlands, but all experience shows that such gases give rise to very significant amounts of scaling.

What has been said above with regard to operations immediately following the manufacture of zinc, such as the preparation of alloys or ingots, also applies to other processes which involve liquid zinc at a temperature above 500° C. This is the case, for example, in the galvanizing of siliconised sheet metal which takes place, as is known, at a higher temperature than normal galvanisation.

Of course, numerous attempts have been made to solve the problem which has just been described. Thus it has been tried unsuccessfully to block up carefully all the entrances through which extraneous air might enter the furnaces, in order to reduce as far as possible the free oxygen content of their atmospheres. Other attempts were by adjusting the burners and even by adapting the reverberatory furnaces themselves to natural gas, but they have not been successful and it can be said that the above problems have not been solved. Moreover, it must be pointed out that oxidation even takes place in the presence of reducing gases from the combustion of natural gas.

In view of the above, it will be understood that one of the aims of the present invention is to provide a process for avoiding the oxidation of liquid zinc in reverberatory furnaces supplied with natural gas. It can also be said in other words that an object of the invention is the provision of a process for improving the working of such furnaces by reducing the rate of formation of scale.

Another object of the invention is the provision of a process of this type which is simple and costs little to put into operation.

These aims, and others which will become apparent from the following, description are realized by means of the process according to the invention, wherein there is injected into the furnace atmosphere a quantity of sulphur dioxide of between 0.01 and 0.04% by volume, and preferably about 0.02% by volume in relation to the volume of the furnace atmosphere.

Those skilled in the art will readily understand how surprising this is. It is in fact known, from the literature, and in particular from PASCAL, Traite de Chimie Minerale, Volume XIII page 1229, that sulphur dioxide $SO_2$ has an oxidising effect on liquid zinc. It is not understood why, instead of taking part in the formation of scale which reveals the oxidation, the injection of $SO_2$, envisaged by the invention, on the contrary suppresses, or at least greatly reduces the formation of scale.

Without the inventor wishing to be limited by any theory, an explanation of this surprising result could reside in the fact that sulphur dioxide slows the rate of oxidation of liquid zinc by the residual oxygen of the fumes, which, it appears, was unknown until now.

Whatever the case, it is clear that the furnace atmosphere must not be too oxidising, which could compromise the success of the operation. Advantageously, its oxygen content is kept at a value of less than about 1.5% by volume, which, of course, can be easily achieved, if necessary after a suitable analysis, by adjusting the rate of injection of combustion air into the furnace.

In addition, according to the invention, the injection of sulphur dioxide into the furnace is preferably achieved by injection into the combustion air, which provides a very simple and cheap way of carrying out the process of the invention.

EXAMPLE.

These tests where carried out in a furnace which formed part of a zinc production unit and which was intended to supply distillation columns. This furnace had a gas-oil adaptable burner made by the NORTH-AMERICAN Company, Ser. No. 113-7. It was supplied with natural gas and its working was regulated in such a way that the fumes contained about 0.5% to 1% free oxygen. More precisely, the air factor, that is to say the ratio of the air injected into the furnace to the quantity stoichiometrically necessary, was kept at a value less than 0.95.

The furnace was charged with cold zinc ingots, at the rate of 55 tons per day, the exit temperature of the liquid zinc being equal to 55° C.

In order to determine the effect of the injection of sulphur dioxide, according to the invention, on the oxidation of the liquid zinc and, consequently, on the formation of scale, various trials were carried out with different $SO_2$ contents, this gas being injected into the combustion air of the furnace. In each case, the weight of scale produced in 24 hours of working was measured. The results are shown in the table below.

| | | | | |
|---|---|---|---|---|
| Quantity of $SO_2$ injected (volume %) | 0 | 0.01 | 0.02 | 0.04 |
| Weight of scale produced in 24 hours (kg) | 2.400 | 110 | 0 | 30 |

-continued

| Remarks | (1) | (2) | (3) |
|---|---|---|---|

Remarks

1. In fact, the sulphur dioxide content of the furnace fumes is equal to 0.0005%, produced by the combustion of odourising gases added to the natural gas.

2. Calculated from the quantity of scale produced in 70 hours, being 330 kg.

3. The quantity of scale produced was so small that the operator did not think it necessary to clear it.

These results show that the injection of sulphur dioxide, according to the invention, allows the oxidation of liquid zinc in reverberatory furnaces supplied by natural gas to be reduced in a spectacular fashion, and, in consequence, the formation of scale in these furnaces to be almost totally eliminated.

Another result of this is that the process, according to the invention, allows the use of natural gas for heating such furnaces while, until now, such use was considered undesirable due to the excessive formation of scale. It is obvious that this replacement of domestic fuel by natural gas represents a distinct advantage because of the lower price of this gas. Besides, this advantage becomes considerable when a crisis situation affects the supply of petroleum products.

Finally, it should be noted that the sulphur dioxide used in the process of the invention could be provided by low grade gases from a lead foundry, which represents an obvious economic advantage.

Of course, the sulphur dioxide used in the process of the invention could be produced by the combustion of any sulphur-containing material.

What is claimed is:

1. A process for preventing the oxidation of liquid zinc in a furnace heated by natural gas utilizing at least one furnace burner and in the presence of a furnace atmosphere comprising air containing free oxygen, comprising injecting into said furnace atmosphere a quantity of sulphur dioxide between about 0.01 and 0.04%, by volume, with respect to the volume of the furnace atmosphere.

2. A process according to claim 1, wherein said quantity of sulphur dioxide is about 0.02% by volume.

3. A process according to claim 1, wherein the sulphur dioxide is injected into the primary air of at least one furnace burner.

4. A process according to claim 1, wherein the free oxygen content of the furnace atmosphere is maintained at a value of less than 1.5% by volume.

5. A process according to claim 1, wherein the temperature of said liquid zinc is over 500° C.

6. A process according to claim 1, wherein the sulphur dioxide used is provided by low grade gases from a lead foundry.

7. A process according to claim 1, wherein the sulphur dioxide used is produced by the combustion of a sulphur-containing material.

* * * * *